US008127728B2

(12) United States Patent
Fischer et al.

(10) Patent No.: US 8,127,728 B2
(45) Date of Patent: Mar. 6, 2012

(54) VANE-TYPE CAM PHASER HAVING DUAL ROTOR BIAS SPRINGS

(75) Inventors: Thomas H. Fischer, Rochester, NY (US); Daniel G. Gauthier, Clarkston, MI (US)

(73) Assignee: Delphi Technologies, Inc., Troy, MI (US)

( * ) Notice: Subject to any disclaimer, the term of this patent is extended or adjusted under 35 U.S.C. 154(b) by 420 days.

(21) Appl. No.: 12/383,208

(22) Filed: Mar. 20, 2009

(65) Prior Publication Data

US 2009/0235884 A1 Sep. 24, 2009

Related U.S. Application Data

(60) Provisional application No. 61/070,365, filed on Mar. 21, 2008.

(51) Int. Cl.
*F01L 1/34* (2006.01)

(52) U.S. Cl. ..... 123/90.17; 123/90.15; 464/160

(58) Field of Classification Search ..... 123/90.15, 123/90.17, 90.16, 90.18; 464/1, 2, 160
See application file for complete search history.

(56) References Cited

U.S. PATENT DOCUMENTS 6,981,477 B2 * 1/2006 Uozaki et al. ..... 123/90.17
7,363,897 B2 4/2008 Fischer et al.

* cited by examiner

*Primary Examiner* — Ching Chang
(74) *Attorney, Agent, or Firm* — Thomas N. Twomey

(57) ABSTRACT

A vane-type camshaft phaser for varying the timing of combustion valves including a first torsional bias spring disposed on a cover plate spring guide and grounded to the cover plate and to a slot in a spring retainer to urge the rotor toward an intermediate locking position from any position retarded of the locking position. A second torsional bias spring also anchored to the cover plate and spring retainer urges the rotor in the advance direction over the full range of phaser authority to compensate for added camshaft torque loads imposed by non-valve actuating functions such as driving a mechanical fuel pump.

8 Claims, 3 Drawing Sheets

VANE-TYPE CAM PHASER HAVING DUAL ROTOR BIAS SPRINGS

RELATIONSHIP TO OTHER APPLICATIONS AND PATENTS

This application claims the benefit of U.S. Provisional Patent Application Ser. No. 61/070,365, filed Mar. 21, 2008, which is hereby incorporated by reference in its entirety.

TECHNICAL FIELD

The present invention relates to vane-type camshaft phasers for varying the phase relationship between crankshafts and camshafts in internal combustion engines; more particularly, to such phasers wherein a locking pin assembly is utilized in a phaser having a first bias spring to assist in locking a phaser rotor at a rotational position intermediate between full phaser advance and full phaser retard positions; and most particularly, to such a phaser having a second bias spring for compensating for additional camshaft torque loads imposed by additional camshaft tasks.

BACKGROUND OF THE INVENTION

Camshaft phasers for varying the phase relationship between the crankshaft and a camshaft of an internal combustion engine are well known. A prior art vane-type phaser generally comprises a plurality of outwardly-extending vanes on a rotor interspersed with a plurality of inwardly-extending lobes on a stator, forming alternating advance and retard chambers between the vanes and lobes. Engine oil is supplied via a multiport oil control valve (OCV), in accordance with an engine control module, to either the advance or retard chambers as required to meet current or anticipated engine operating conditions.

In a typical prior art vane-type cam phaser, a controllably variable locking pin is slidingly disposed in a bore in a rotor vane to permit rotational locking of the rotor to the stator (or sprocket wheel or pulley) under certain conditions of operation of the phaser and engine. In older prior art phasers, it is desired that the rotor be locked at an extreme of the rotor authority, typically at the full retard position. To assist in positioning the rotor, it is known to incorporate a mechanical stop for the rotor and a torsional bias spring acting between the rotor and the stator to urge the rotor against the stop at the desired position for locking.

In newer prior art phasers, it is desirable that the rotor be lockable to the stator at an intermediate position in an increased rotor range of rotational authority. A known problem in such phasers is that there is no mechanical means such as a stop to assist in positioning the rotor for locking in an intermediate position; thus, locking is not reliable, and an unacceptably high rate of locking failures may occur. This problem is addressed by the torsional bias spring invention disclosed in U.S. Pat. No. 7,363,897, issued Apr. 29, 2008.

A problem not addressed is that the torsion bias spring may generate an unwanted torque on the rotor about an axis orthogonal to the rotor axis, causing the rotor to become slightly cocked within the stator chamber before the phaser is installed onto the end of a camshaft during engine assembly. This cocking is permitted by necessary clearances between the rotor and the stator. Although relatively slight, such cocking can be large enough to prohibit entry of the camshaft into the rotor during engine assembly.

An additional problem more recently recognized is the fact that in many modern engines the camshaft is called upon to perform cyclic functions in addition to the opening and closing of combustion valves. For example, it is known to employ an additional camshaft lobe to positively drive a piston pump for supplying fuel to an engine fuel rail in a direct-injection engine. The additional torque load in the phase-retard direction can impede the function of the bias spring and also slow the response of the rotor in the advance direction beyond the rotary locking position at which point the bias spring no longer engages the rotor.

What is needed in the art is an improved vane-type camshaft phaser wherein the rotor may be reliably locked to the stator at an intermediate position in the range of authority, and wherein the rotor of an assembled phaser may be reliably entered onto the end of a camshaft during engine assembly, and wherein the additional torque load on the camshaft is compensated within the phaser over the full range of phaser authority.

It is a primary object of the present invention to improve the operational reliability of a camshaft phaser.

SUMMARY OF THE INVENTION

Briefly described, a vane-type camshaft phaser in accordance with the invention for varying the timing of combustion valves in an internal combustion engine includes a rotor having a plurality of vanes disposed in a stator having a plurality of lobes, the interspersion of vanes and lobes defining a plurality of alternating valve timing advance and valve timing retard chambers with respect to the engine crankshaft. The rotational authority of the rotor within the stator with respect to top-dead-center of the crankshaft is preferably between about 40 crank degrees before TDC (valve timing advanced) and about 30 crank degrees after TDC (valve timing retarded). It is generally desirable that an engine be started under an intake phaser position of about 10 crank degrees valve retard. Thus, a phaser in accordance with the present invention includes a seat formed in the stator at the appropriate position of intermediate rotation and a locking pin slidably disposed in a vane of the rotor for engaging the seat to lock the rotor at the intermediate position.

A first pre-loaded bias spring disposed on the phaser cover plate urges the rotor toward the locking position from any rotational position retarded of the locking position. When the rotor is moving in a phase-advance direction, at or near the rotor locking position the bias spring system becomes disengaged from the rotor. When the rotor is moving in a phase-retard direction, at or near the rotor locking position the bias spring system is engaged, causing the rotor to decelerate and thereby increasing the reliability of locking.

A first improvement over the prior art is a cylindrical spring guide extending axially from the phaser cover plate to prevent any spring distortion from reaching the rotor and thereby undesirably cocking the rotor within the stator.

A second improvement over the prior art is a second bias spring engaged with the rotor and the stator to bias the rotor in a phase-advance direction over the full range of phaser authority to compensate for additional phase-retarding torque loads imposed on the camshaft by additional non-valve actuation functions such as mechanically pumping fuel.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
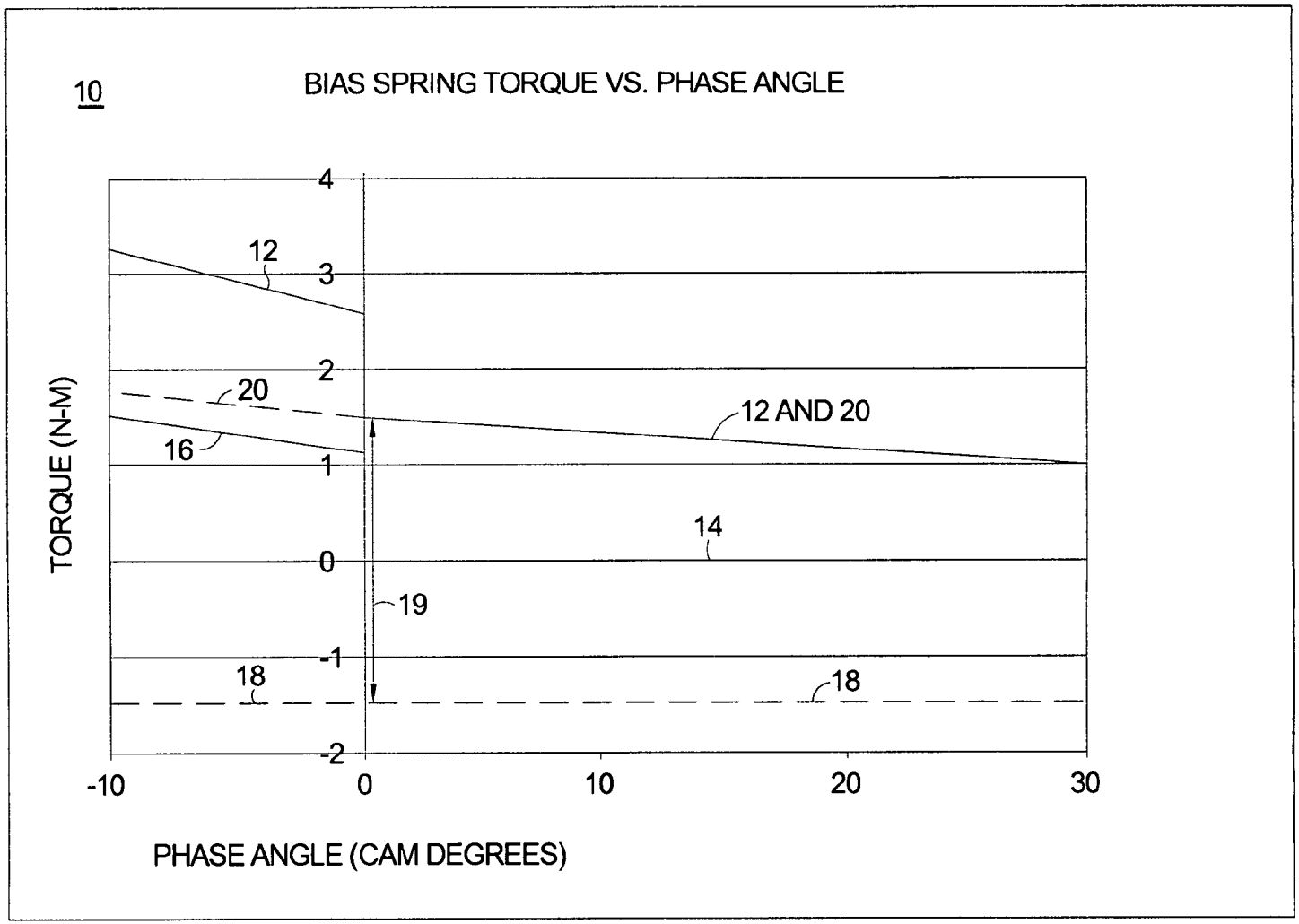
FIG. 1 is graph showing various torque relationships within a camshaft phaser in accordance with the present invention as a function of phase angle.
Figure 2:
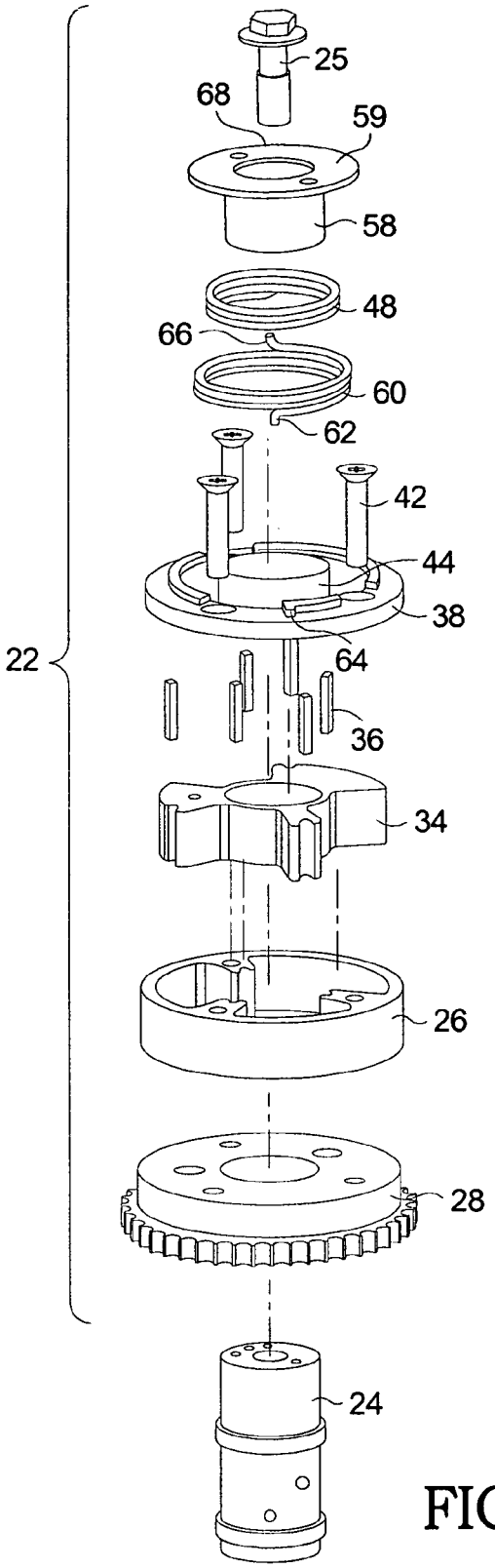
FIG. 2 is an exploded isometric view of a dual-spring camshaft phaser in accordance with the present invention.
Figure 3:
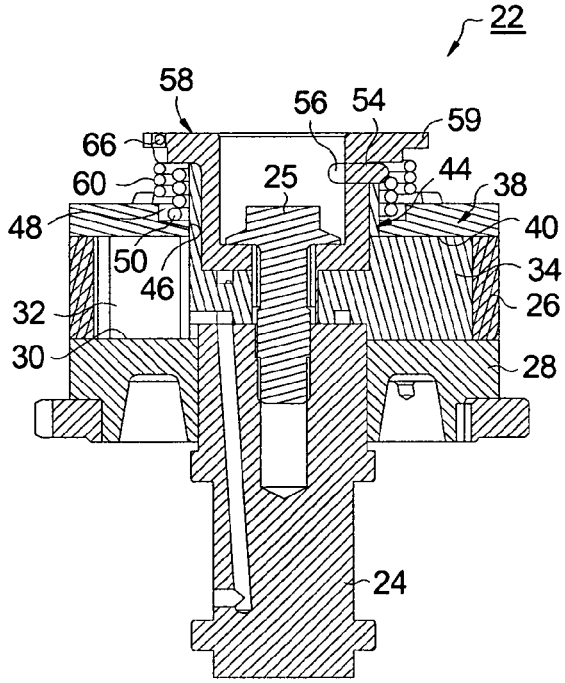
FIG. 3 is an elevational cross-sectional view of the phaser shown in FIG. 2.
Figure 4:
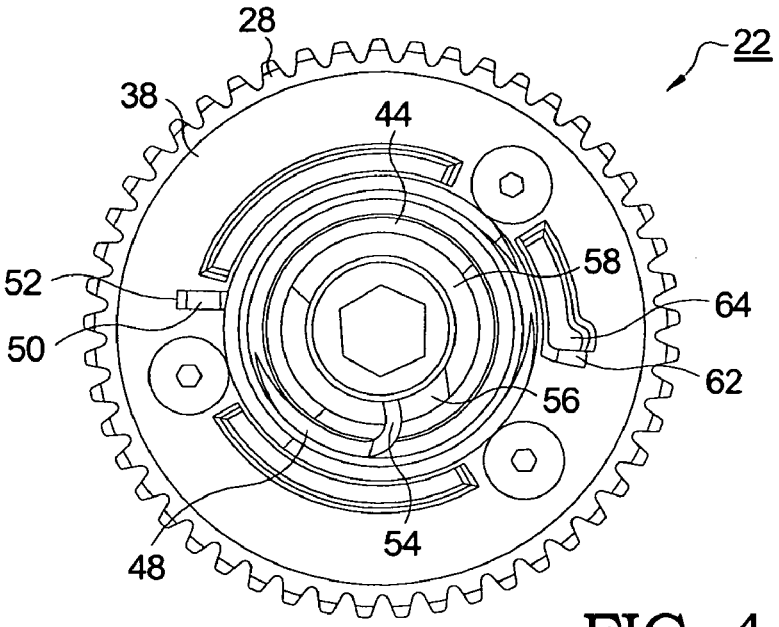
FIG. 4 is a top view of the phaser shown in FIGS. 2 and 3.

Referring to FIG. 1, graph 10 shows the interrelationships of various torque and bias spring functions in a camshaft phaser in accordance with the present invention. A rotational locking position of a rotor to a stator is defined as 0° phase angle. To permit reliable locking, the net torque on the rotor must be in the vicinity of zero Newton-meters. During engine cold start, the bias spring system comprising two bias springs as described below exerts a net torque in the phase-advance direction that exceeds the torque of the camshaft in the phase-retard direction, causing the rotor to be advanced from a fully retarded starting position (−100) to the locking position (0°). This is shown in Curve 12. Thereafter, at all rotor phase angles advanced from 0°, it is desired that the bias spring system exert little or no net torque, as shown in Curve 14. In the prior art, this is accomplished with a single bias spring (the innermost of two springs in the present invention as described below) that disengages from the rotor at all phase angles greater than 0°, shown by Curve 16. However, as noted above, in many modern engines the camshaft carries a torque load greater than that imposed only by the valve trains because of additional cyclic drive requirements. In the present example, a fixed additional negative (retarding) torque load of about −1.4 Nm is shown (Curve 18) as exemplary of such an additional torque imposition. In the present invention, this additional negative torque load is compensated (difference 19), by a second bias spring weaker than the first bias spring but extending over the entire range of phaser authority, as shown in Curve 20.

Referring to FIGS. 2 through 5, a dual-spring camshaft phaser 22 in accordance with the present invention is shown for mounting to the end of an engine camshaft 24 by a bolt 25. A hollow stator 26 is mounted on a sprocket 28 that also forms a first end wall 30 of the phaser advance and retard chambers 32. A tri-vaned rotor 34 having vane seals 36 is disposed within stator 26. A cover plate 38 forms a second end wall 40 of the phaser advance and retard chambers 32 and is through-bolted to sprocket 28 by bolts 42. The phaser as recited thus far is known in the prior art.

Figure 5:
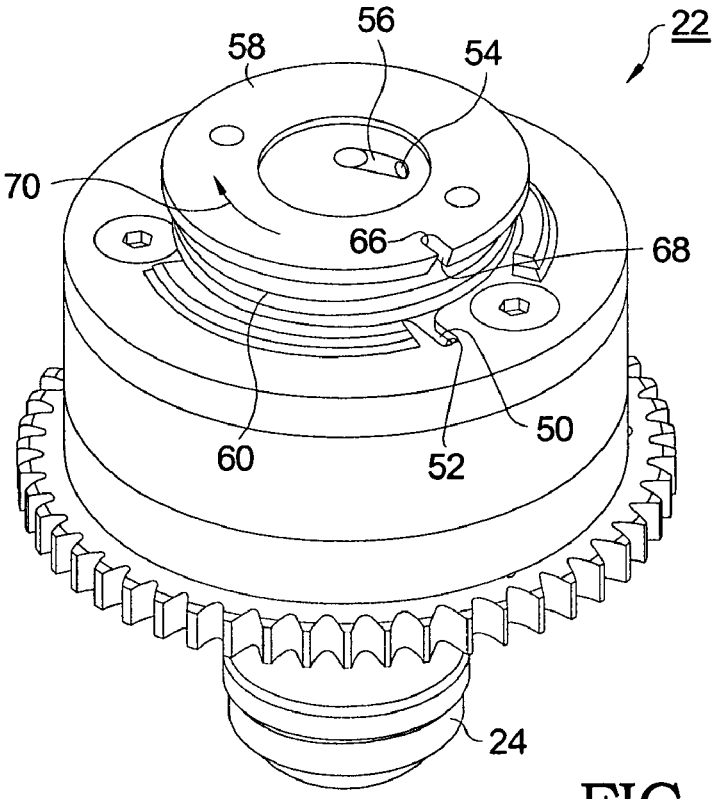
FIG. 5 is an isometric view from above of a complete phaser in accordance with the present invention.

Cover plate 38 is provided with a cylindrical spring guide 44 extending axially from a central opening 46 in the cover plate for supporting a first and radially inner bias spring 48. First bias spring 48 has a first radial tang 50 grounded in a well 52 in cover plate 38, and a second tang 54 grounded in a slot 56 in a spring retainer 58 extending through spring guide 44 into contact with rotor 34. Bolt 25 captures spring retainer 58 and rotor 34 against camshaft 24, thus assuring that the spring retainer and rotor turn as a unit with the camshaft. (Note that in FIG. 4, the radial flange 59 on spring retainer 58 is omitted for clarity.) Slot 56 is positioned rotationally such that second tang 54, extending radially inward, engages a wall of the slot, as shown in FIG. 5, at all phase angles between 0° and −10° (cam). Thus, first bias spring 48 functions identically with the bias spring arrangement disclosed in U.S. Pat. No. 7,363,897 (and see Curve 12 in FIG. 1). However, an important improvement over that disclosure is the addition of spring guide 44 extending from cover plate 38 which completely isolates torsional deformations in spring 48 from contact with spring retainer 58 and rotor 34, thus preventing undesirable cocking of the rotor in the stator. In the prior art disclosure, a spring retainer extends inward through the spring from a target wheel, similar to spring retainer 58, for supporting the spring, but the spring is in full contact with the spring retainer and thus distortions in the spring are transmitted to the rotor via the spring retainer. Note that, for these reasons, a spring guide 44 is in itself and improvement suitable for a camshaft phaser for use in an engine without additional torque demands on the camshaft.

Still referring to FIGS. 2 through 5, a second and radially outer bias spring 60 is disposed outboard of first bias spring 48 and includes a third tang 62 extending radially outward and grounded on cover plate 38 by a raised stop 64. A fourth tang 66 extends axially and is engaged in a notch 68 formed in spring retainer 58. Notch 68 is rotationally positioned such that second bias spring 60 is torsionally compressed at all times and thus tends to uncoil in the phaser-advance direction 70; as it does so, the spring compression decreases slightly, accounting for the fact in FIG. 1 that at advance angles beyond 0° Curve 20 is not quite parallel with Curve 18. The important feature, however, is that at the locking phase angle of 0°, the positive torque of second bias spring 60 just compensates for the added negative torque load of non valve-actuating camshaft functions.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A camshaft phaser for selectively varying the phase of a camshaft with respect to a crankshaft in an internal combustion engine, comprising:

a) a stator;

b) a rotor disposed within said stator;

c) a cover plate associated with said stator and enclosing said rotor within said stator;

d) a spring guide extending from said cover plate;

e) a coil bias spring disposed about said spring guide and having first and second tangs; and f) a spring retainer associated with said rotor, wherein said first tang is fixed to move with said stator, wherein said second tang is in contact with said spring retainer, and wherein said second tang is engaged with a wall of a slot in said spring retainer, said second tang being engaged with said wall at all phase angles less than zero and being disengaged from said wall at all phase angles greater than zero.

2. A camshaft phaser in accordance with claim 1 wherein said first tang is grounded to said cover plate.

3. A camshaft phaser in accordance with claim 1 wherein said first tang is grounded in a well in said cover plate.

4. A camshaft phaser for selectively varying the phase of a camshaft with respect to a crankshaft in an internal combustion engine, comprising:

a) a stator;

b) a rotor disposed within said stator;

c) a cover plate associated with said stator and enclosing said rotor within said stator;

d) a spring guide extending from said cover plate;

e) a coil bias spring disposed about said spring guide and having first and second tangs; and f) a spring retainer associated with said rotor, wherein said first tang is fixed to move with said stator, wherein said second tang is in contact with said spring retainer, wherein said coil bias spring is a first coil bias spring, said phaser further comprising a second coil bias spring having third and fourth tangs, wherein said third tang is fixed to move with said stator and said fourth tang is fixed to move with said rotor wherein said third tang is grounded against said cover plate, and wherein said fourth tang is grounded against said spring retainer.

5. A camshaft phaser in accordance with claim 4 wherein said second coil bias spring is weaker than said first coil bias spring.

6. A camshaft phaser for selectively varying the phase of a camshaft with respect to a crankshaft in an internal combustion engine, comprising:

a) a stator;

b) a rotor disposed within said stator;

c) a cover plate associated with said stator and enclosing said rotor within said stator;

d) a spring guide extending from said cover plate;

e) a coil bias spring disposed about said spring guide and having first and second tangs; and f) a spring retainer associated with said rotor, wherein said first tang is fixed to move with said stator, wherein said second tang is in contact with said spring retainer, wherein said coil bias spring is a first coil bias spring, said phaser further comprising a second coil bias spring having third and fourth tangs, wherein said third tang is fixed to move with said stator and said fourth tang is fixed to move with said rotor, and wherein the strength of said second coil bias spring is selected to compensate for non-valve activating torque loads imposed on said camshaft.

7. An internal combustion engine comprising a camshaft phaser for selectively varying the phase of a camshaft with respect to a crankshaft, said camshaft phaser including a stator, a rotor disposed within said stator, a cover plate associated with said stator and enclosing said rotor within said stator, a spring guide extending from said cover plate, a coil bias spring having first and second tangs, and a spring retainer associated with said rotor, wherein said first tang is fixed to rotate with said stator, and wherein said second tang is engaged with said spring retainer, said second tang being engaged with said spring retainer at all phase angles less than zero and being disengaged from said spring retainer at all phase angles greater than zero.

8. An internal combustion engine comprising a camshaft phaser for selectively varying the phase of a camshaft with respect to a crankshaft, said camshaft phaser including a stator, a rotor disposed within said stator, a cover plate associated with said stator and enclosing said rotor within said stator, a spring guide extending from said cover plate, a first coil bias spring having first and second tangs, a second coil bias spring having third and fourth tangs, and a spring retainer for engaging said first and second coil bias springs extending into contact with said rotor, wherein said first tang is grounded to said cover plate, and wherein said second tang is grounded to said spring retainer, said second tang being engaged with said spring retainer at all phase angles less than zero and being disengaged from said spring retainer at all phase angles greater than zero, and wherein said third tang is grounded to said cover plate, and wherein said fourth tang is grounded to a said spring retainer.

* * * * *